US005231933A

United States Patent [19]

DiRosa

[11] Patent Number: 5,231,933

[45] Date of Patent: Aug. 3, 1993

[54] MATERIAL CONVEYOR SYSTEM COMPRISING POWERED TROLLEYS ON AN OVERHEAD RAIL, THE RAIL HAVING VARYING THICKNESS CURVED RAIL SECTIONS TO MAINTAIN A CONSTANT SPRING COMPRESSION ON A ROLLER DURING TRAVERSAL OF GRADES

[75] Inventor: Gaetano DiRosa, Turin, Italy

[73] Assignee: Fata Automation S.p.A., Italy

[21] Appl. No.: 800,321

[22] Filed: Dec. 3, 1991

[51] Int. Cl.[5] ..... B61C 15/00

[52] U.S. Cl. ..... 105/73; 104/93; 105/153

[58] Field of Search ..... 104/93; 105/30, 153

[56] References Cited

U.S. PATENT DOCUMENTS

| | | | |
|---|---|---|---|
| 3,648,617 | 3/1972 | Metzner et al. | 105/73 X |
| 3,774,548 | 11/1973 | Borst | 105/73 X |
| 4,644,873 | 2/1987 | Uttscheid | 105/29.1 |
| 4,716,839 | 1/1988 | Catena | 105/153 |
| 5,069,141 | 12/1991 | Ohara et al. | 105/73 X |

FOREIGN PATENT DOCUMENTS 202807 5/1985 Italy .

*Primary Examiner*—Robert J. Oberleitner
*Assistant Examiner*—S. Joseph Morano
*Attorney, Agent, or Firm*—Finnegan, Henderson, Farabow, Garrett & Dunner

[57] ABSTRACT

A conveyor system (10) with an overhead rail (11) has trolleys (12) with an upper drive wheel (13) and lower bucking rollers (15,16) of which at least one is fitted with a spring (17) to provide the necessary traction between drive wheel (13) and rail (11) along sloping paths. The rail (11) has a first unvarying thickness in its horizontal sections (20) and a second thickness, greater than the first, in its sloping sections (21), while the radiused sections (22,23) between horizontal sections (20) and sloping sections (21) have a variable thickness sized to hold substantially constant the compression of the spring (17) along the entire radiused sections (22,23) and in particular, at a value substantially equal to that provided by the spring along the sloping sections (21).

4 Claims, 1 Drawing Sheet

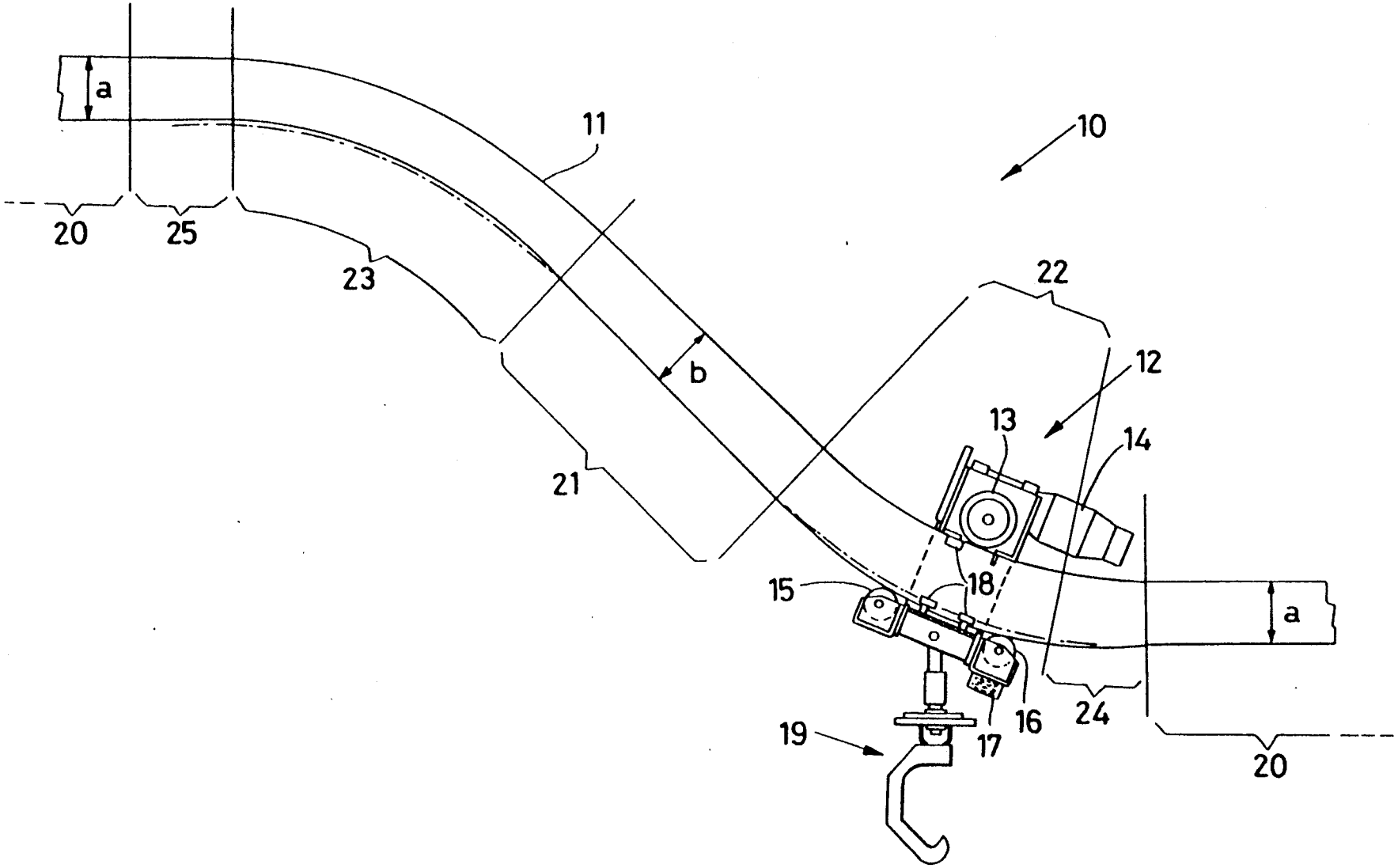
10
11
12
13
14
15
16
17
18
19
20
21
22
23
24
25
a
b

MATERIAL CONVEYOR SYSTEM COMPRISING POWERED TROLLEYS ON AN OVERHEAD RAIL, THE RAIL HAVING VARYING THICKNESS CURVED RAIL SECTIONS TO MAINTAIN A CONSTANT SPRING COMPRESSION ON A ROLLER DURING TRAVERSAL OF GRADES

BACKGROUND OF THE INVENTION

In the art of internal transportation in factories, there are often used self-powered industrial material handling systems, which consist of a suspended monorail on which run powered trolleys powered through an electric distribution line arranged along the rail.

The trolleys usually have a drive wheel above the monorail and bucking rollers placed below it. Traction is thus assured by the adherence of the powered upper wheel on the monorail. This adherence is usually sufficient for movement on the level or along slight rises due to the weight of the trolley itself including the load carried by it and pulling down on the drive wheel.

For sloping sections with relatively steep slopes there have been proposed lower bucking rollers equipped with a pressure means such as a spring-loaded system that pushes the rollers toward the rail so as to increase the adherence or traction of the drive wheel on the rail as described for example in Italian patent No. 202,807 in the name of FATA European Group.

The use of bucking rollers, however, causes problems due to variations in the compression of the pressure means in the curved and radiused sections between sections with different slopes. The bucking rollers are usually two in number and are positioned along the chords of the curved sections. Hence if they are inside a curve they tend to draw away the powered wheel and if they are on the outside they draw near it. Consequently, in the former case, the springs are more compressed and in the latter case they are less compressed slope variations.

To prevent these compression differences from causing excessive and deleterious variations in traction, there have been proposed various solutions which, however, suffer from several drawbacks.

For example, there have been proposed thrust springs with a length much greater than the extension caused by variations in the rail curvature so that the resulting thrust variation is as limited as possible. A solution of this type, however, suffers from the size of the springs, which penalizes the compactness of the trolley design and requires greater spacing of the loads from the rail, which thus must be placed in a higher position. To obviate at least partially the problem, there have been used linkages and transmissions added to the bucking system or springs with several concentric stages with an increase in complexity and hence cost of the trolley, introducing also greater probability of breakdown.

Thrust means for the bucking wheels having substantially constant operation have the further disadvantage of supplying the same friction necessary for rising travel even during travel on horizontal sections where the weight of the trolley would be sufficient to ensure adherence of the drive wheel. This uselessly stresses the mechanical parts of the trolley and increases wear on the rolling members and the rail.

The general object of the present invention therefore is to obviate the drawbacks mentioned above by proving a conveyor system of the self-powered type which, while it can have trolleys of limited size and complexity, allow the use of ascending and descending ramps with relatively steep slopes without additional movement means and without introducing disadvantages for level travel.

SUMMARY OF THE INVENTION

In view of said object, the present invention provides a conveyor system with an overhead rail comprising trolleys with at least one upper drive wheel and plurality of lower bucking rollers pushed against the rail by pressure means to supply the necessary adherence between the drive wheel and the rail along sloping paths, characterized in that the rail has a first unvarying thickness in its horizontal sections and a second thickness, greater than the first, in its sloping sections. The radiused or curved sections between the level sections and the sloping sections having a thickness varying progressively in order to hold substantially constant the compression of the pressure means along the entire radiused section and at a value substantially equal to that generated by the pressure means along the sloping sections.

BRIEF DESCRIPTION OF THE DRAWINGS

To further clarify the explanation of the innovative principles of the present invention and its advantages as compared with the known art, there is described below with the aid of the drawing an embodiment applying said principles.

The drawing shows schematically a sloping section of a material conveyor system constructed in accordance with the present invention.

DETAILED DESCRIPTION OF THE INVENTION

The system generally indicated by reference number 10 includes at least one independently powered trolley 12 running on a rail 11. Each trolley comprises an upper drive and support wheel 13 kinematically connected to a drive means such as an electric motor 14 and a pair of opposed, idling bucking rollers 15 and 16. At least one roller 16 is mounted to run under the thrust or influence of a biasing or pressure means 17, e.g., a spring, to press the roller against the lower edge of the rail 11 and ensure adherence of drive wheel 13 against the upper edge of the rail. Laterally of the trolley are also located idling rollers 18 for guiding the trolley along the vertical sides of the rail. The roller 13 mounted in a driven manner can be arranged at the front or the rear in relation to the direction of travel of the trolley depending on normal practical requirements. At the bottom, the trolley 12 has support means 19 for hanging the loads to be conveyed, such as for example automotive vehicle parts along an assembly line.

Preferably, upper drive wheel 13 and the two lower bucking rollers 15,16 are arranged at the vertices of an isosceles triangle, the rollers 15,16 being at the base thereof, and the spring 17 presses the roller 16 against the rail in a direction perpendicular thereto.

In accordance with the present invention, as may be seen in the drawing, in the sections of the rail where changes in the height of the rail are necessary, whether for ascent or descent of the trolleys, the rail does not have a constant thickness, but is ideally divided in segments each of which has a specific progression in its thickness. In particular, as the rail changes from a horizontal section, indicated by number 20, in which it has a normal and constant thickness "a", to a sloping section 21, it has a thickness "b", which is also substantially constant, but is greater than thickness "a" of section 20.

The spring 17 is designed so that it will produce on the drive wheel 13 the necessary preloading for ascending travel when the trolley passes over thickened sections 21. In this manner, in the horizontal sections 20 the thrust of the spring is reduced so that the bucking rollers are not a source of useless friction, because there the weight of the trolley is sufficient to prevent slipping of the drive wheel, but in the sloping sections 21, the thrust is increased by the increased thickness of the rail for the trolley to ascend it.

In the curved or radiused sections between the changes in slope, as shown in the drawing, the thickness changes gradually or progressively and is dimensioned so that it holds the compression of the spring substantially constant and hence the thrust on the bucking rollers at a predetermined value. In particular, for the entire length of the curves, the distance of the upper wheel from the lower bucking rollers is held substantially constant and at the same value as it is in the sloping section 21, so that the compression of the spring will not vary whether the upper drive wheel is on a concave part of a curve, as at 22 where the rail is thicker than at section 21, or on a convex part of a curve, as at 23 where the rail is thinner than at section 21. Note the dot-dash lines in sections 22 and 23 indicating the comparative thickness of section 21 to the varying thickness of these sections.

Between the sections 20,22 and 23,20 there are transition sections 24 and 25, respectively, that are substantially level or at least are at a slope which the trolley can negotiate with the thrust of the bucking rollers near that of level travel. In sections 24 and 25, the rail thickness varies transition between sections 20 and 22 and between 23 and 20 respectively.

Because of this particular form of the rail, the trolleys only need pressure springs with limited travel and hence reduced dimensions, their travel being only between the compressed position on the sections 21 and the lesser compression position on the sections 20. In addition, between these two positions it is not necessary that the spring have approximately constant thrust, but instead the thrust is advantageously carried to fall to a minimum on the horizontal sections, thus reducing rolling friction in those sections.

The above description of an embodiment applying the innovative principles of the present invention is given merely by way of example and therefore should not be taken as a limitation of the invention. For example, although a trolley of the single-trolley type has been shown and described, i.e. a type with a single upper drive wheel, it is possible to provide in accordance with the present invention, as may readily be imagined by those skilled in the art, trolley of the twin- or multitrolley type, i.e. made up of two or more single trolleys interconnected by a hinged joint.

I claim:

1. In a conveyor system having an overhead suspended rail having horizontal rail sections of a constant thickness and sloping rail sections of a constant thickness between horizontal rail sections at different levels and a powered trolley having support means for holding a load adapted to run along said rail, said trolley having at least one upper drive wheel running along a top side of the rail, a plurality of lower bucking rollers spaced from one another in the direction of travel of the trolley and running along a bottom side of the rail and pressure means for pressing at least one of said lower rollers against said rail to create traction between the drive wheel and the rail and wherein the constant thickness of the sloping rail sections is greater than the constant thickness of the horizontal rail sections to increase the compression of the pressure means in said sloping rail sections relative to the compression of the pressure means in said horizontal rail sections, the improvement comprising a first curved rail section having a concave top side and a convex bottom side located between one of the sloping rail sections and a lower horizontal section, and a second curved rail section having a convex top side and a concave bottom side between said one sloping rail section and a higher horizontal rail section, said first and second curved rail sections having a thickness that varies gradually in the direction of travel of the trolley, the minimum thickness of the first curved rail sections being equal to and the maximum thickness being greater than the thickness of the one sloping rail section, while the maximum thickness of the second curved rail section is equal to and the minimum thickness is less than the thickness of the one sloping rail section, so that the compression of the pressure means is substantially constant during travel of the trolley along said curved rail sections and at a value substantially equal to its compression during travel of the trolley along said one sloping rail section.

2. The system of claim 1, wherein the trolley has one upper drive wheel and two lower bucking rollers, said wheel and rollers forming an isosceles triangle with the rollers the base thereof and the pressure means presses at least one of said bucking rollers against the rail in a direction substantially perpendicular thereto as it passes through each of said sections.

3. The system of claim 2, wherein the pressure means is a spring.

4. The system of claim 1, including transition rail sections joining said horizontal rail sections with said curved rail sections and having a varying thickness in the direction of travel of the trolley to accommodate the differences in thickness between said horizontal and curved rail sections.

* * * * *